US009932537B2

(12) United States Patent
Schunk

(10) Patent No.: US 9,932,537 B2
(45) Date of Patent: Apr. 3, 2018

(54) WILDERNESS SURVIVAL DEVICE

(71) Applicant: Martin J. Schunk, Enfield, NH (US)

(72) Inventor: Martin J. Schunk, Enfield, NH (US)

( * ) Notice: Subject to any disclaimer, the term of this patent is extended or adjusted under 35 U.S.C. 154(b) by 49 days.

(21) Appl. No.: 14/861,149

(22) Filed: Sep. 22, 2015

(65) Prior Publication Data

US 2017/0081607 A1 Mar. 23, 2017

(51) Int. Cl.
*C10L 11/04* (2006.01)
*C10L 11/06* (2006.01)

(52) U.S. Cl.
CPC ..... *C10L 11/04* (2013.01); *C10L 11/06* (2013.01); *C10L 2290/06* (2013.01); *C10L 2290/32* (2013.01)

(58) Field of Classification Search
CPC ..... C10L 11/06; C10L 5/36; C10L 5/146
USPC ..... 44/519, 542, 544, 532, 533, 275
See application file for complete search history.

(56) References Cited

U.S. PATENT DOCUMENTS 2,094,661 A 10/1937 Macleay et al.
3,613,658 A * 10/1971 Knowles ..... A01G 13/06 12/59.5
4,386,937 A 6/1983 Fareri et al.
4,568,270 A * 2/1986 Marcus ..... C11C 5/002 422/126
4,810,256 A * 3/1989 Fay, III ..... C10L 5/44 44/530
4,855,098 A * 8/1989 Taylor ..... C11C 5/002 106/270
6,136,053 A * 10/2000 Sullivan ..... C10L 11/04 44/506
6,214,295 B1 * 4/2001 Freeman ..... C11C 5/002 422/126
6,544,303 B2 * 4/2003 Calzada ..... C11C 5/008 431/288
6,730,137 B2 * 5/2004 Pesu ..... C10L 5/44 431/288
7,018,432 B2 * 3/2006 Moussouni ..... C11C 5/002 106/270
8,216,322 B2 7/2012 Schweickhardt
2002/0032982 A1 * 3/2002 Berger ..... C11C 5/002 44/519
2005/0023714 A1 2/2005 Manner
2006/0236599 A1 10/2006 Lehman
2008/0083159 A1 * 4/2008 Doepker ..... C10L 5/36 44/576
2012/0328995 A1 12/2012 Fandrich
2014/0283440 A1 * 9/2014 Beadles ..... C10L 5/146 44/522

* cited by examiner

*Primary Examiner* — Ellen M McAvoy
(74) *Attorney, Agent, or Firm* — Polsinelli, PC

(57) ABSTRACT

A fire starter device and method for producing the same capable of igniting a fire sustaining fuel source in adverse conditions typically associated with wilderness survival or emergency situations. A wick element facilitates ignition of the fire starter and extends through a generally cubical outer shell into a solid fuel inner core. The wick element can include one or more wicks associated with a wax, each wick including multiple strands of one or more wicking materials. The outer shell provides a hard, non-greasy external surface for the fire starter and substantially encapsulates the solid fuel inner core. The solid fuel inner core includes a fibrous material associated with a wax and can provide fuel to the flame of the fire starter.

20 Claims, 4 Drawing Sheets

WILDERNESS SURVIVAL DEVICE

TECHNICAL FIELD

The present technology pertains to fire starters and more specifically to solid fuel fire starters and methods for producing the same.

BACKGROUND

Fire starting has been an essential survival skill for thousands of years. Traditional fire starting methods involve placing dry kindling or other suitable tinder under a fire sustaining fuel source such as wood logs. From here, the kindling or tinder is ignited which in turn ignites the wood logs or other fire sustaining fuel sources. However, the success in using traditional fire starting methods largely depends on factors such as the type and quantity of kindling, the dryness of the wood logs or other fuel sources, the weather conditions, the skill of the user, and other similar factors.

Consequently, the quest for devices to improve the success rate and reliability of fire starting has been underway for many years. The majority of proposed solutions have attempted to replace traditional kindling with liquid, solid, or gel fuel sources. However, many of these devices have undesirable attributes such as being highly flammable, admitting toxic fumes when burned, having a strong chemical odor, not being safe to handle, ship, and store, or requiring special containers to keep them waterproof. Moreover, proposed solutions have failed to provide an easy to light device capable of igniting a fire sustaining fuel source in extreme weather conditions, such as high winds, torrential rain, or blowing snow, when starting a fire can be challenging. Therefore, a device that is easy to ignite and capable of sustaining a substantially large flame in adverse weather conditions would be advantageous for improving the success rate and reliability of fire starting in survival situations.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1A:
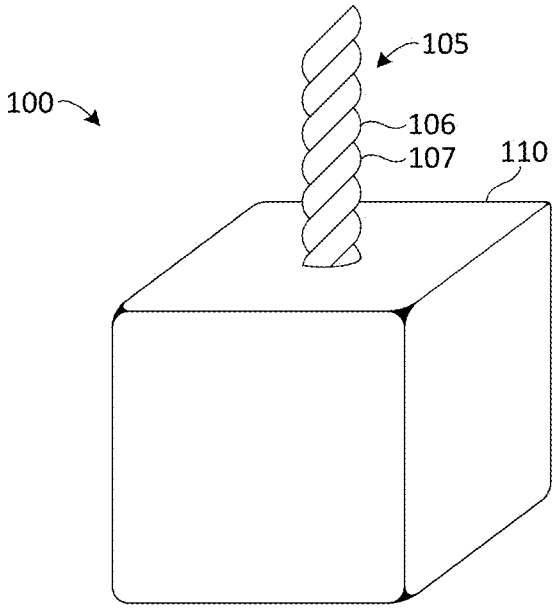
FIG. 1A illustrates a perspective view of a generally cubical fire starter in accordance with an exemplary embodiment.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The terms "associate", "associated", "associating", or "association" as used herein are defined as being either absorption or adsorption. For example, a fibrous material associated with a wax is defined as the absorption of the wax by the fibrous material or the adsorption of the wax to the fibrous material. Absorption of wax by the fibrous material is typically done through processes such as immersing the fibrous material in a pool of molten wax. Adsorption of the wax to the fibrous material is typically carried out through processes such as brushing or spraying wax onto the fibrous material.

Disclosed is a fire starter device capable of igniting a fire sustaining fuel source in adverse conditions typically associated with wilderness survival or emergency situations. A wick element (i.e., lighting wick) facilitates ignition of the fire starter and extends through a generally cubical outer shell into a solid fuel inner core. The wick element can include one or more wicks associated with a wax, each wick including multiple strands of one or more wicking materials. The outer shell provides a hard, non-greasy external surface for the fire starter and substantially encapsulates the solid fuel inner core. The solid fuel inner core includes a fibrous material associated with a wax and can provide fuel to the flame of the fire starter.

Also disclosed is a method of producing a fire starter device. The process begins with inserting a portion of a wick element into a piece of fibrous material. Next, the portion of the wick element and the piece of fibrous material is enclosed within a mold. From here, a semi-soft wax is melted and poured into the mold. The semi-soft wax is then cooled to form a solid fuel inner core including the portion of the wick element and the fibrous material associated with the semi-soft wax. Next, the solid fuel inner core is removed from the mold and dipped in a melted hard wax. The hard wax is cooled to form an outer shell substantially encapsulating the solid fuel inner core.

FIG. 1A illustrates a perspective view of a fire starter 100 in accordance with an exemplary embodiment. The fire starter 100 includes a wick element 105 protruding from a generally cubical outer shell 110 and configured to facilitate ignition of fire starter 100. The wick element 105 can be a single wick or can include multiple wicks 106, 107 braided or twisted together. Further, the one or more wicks 106, 107 in wick element 105 can each include multiple individual strands of one or more wicking materials, such as cotton, fiberglass, aramid, denim, hemp, wood, paper, and the like. As a non-limiting example, eight individual wicks of four ply cotton yarn can be twisted or braided together to form the wick element 105. By using multiple wicks, the wick element 105 is more capable of sustaining a flame and igniting fire starter 100 in adverse weather conditions, such as high winds, torrential rain, or blowing snow. For instance, in situations where adverse weather conditions extinguish one of the multiple wicks, a neighboring wick can subsequently reignite the extinguished wick to sustain the flame.

The wick element 105 can also include a stiffener to increase the rigidity of the wick element and to aid in heat conduction. The stiffener can be a zinc stiffener, a copper stiffener, a paper stiffener, a cotton stiffener, and the like, and can be intertwined with the one or more wicks or can serve as a core surrounded by the wicks. The wick element 105 can be treated with dyes or various other solutions through processes such as mordanting to improve aesthetics, flame resistance, wick rigidity, and the like. Further, the wick element 105 can be associated with a wax, such as paraffin wax, soy wax, beeswax, gel wax, palm wax, or other waxes, to increase the rigidity and waterproof the wick element.

Figure 1B:
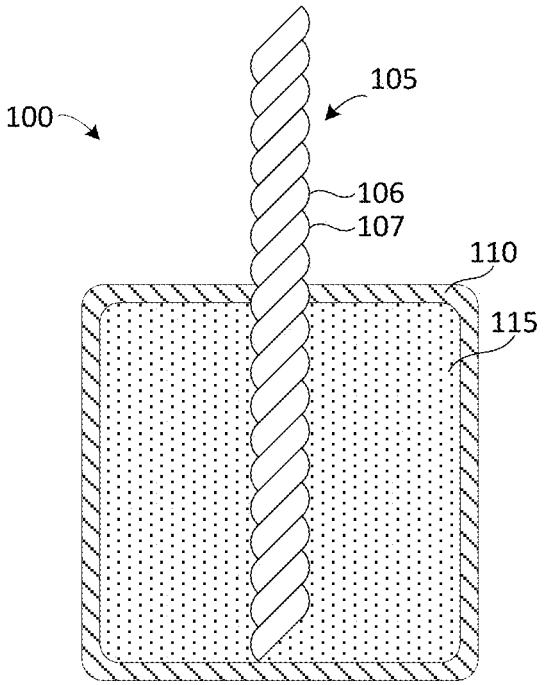
FIG. 1B illustrates a cross-sectional view of a generally cubical fire starter in accordance with an exemplary embodiment.

The outer shell 110 can be an external shell which substantially encapsulates an inner core, such as solid fuel inner core 115 shown in FIG. 1B. As illustrated in FIG. 1A, outer shell 110 can have a generally cubical shape, although other shapes and sizes are contemplated, such as the generally spherical outer shell pictured in FIG. 2A. The outer shell 110 can provide a hard, non-greasy outer surface for fire starter 100 and can be a wax, such as paraffin wax, soy wax, beeswax, gel wax, palm wax, or other waxes. In some cases, the outer shell 110 can be a hard paraffin wax with a melting point between about 140° F. and about 170° F., and more preferably between about 150° F. and about 165° F. The outer shell 110 can also include one or more additive materials, such as a dye, a fragrance, an oil, an accelerant, a wax, an acid, and the like.

As depicted in the cross-sectional view of fire starter 100 in FIG. 1B, the wick element 105 can extend through the outer shell 110 into a solid fuel inner core 115. A bottom portion of the wick element 105 (i.e. the portion of the wick element extending into the solid fuel inner core) can be integrally molded with the solid fuel inner core 115 such that the inner core substantially encapsulates the portion of the wick element and forms a solid piece containing the portion of the wick element.

The solid fuel inner core 115 can include one or more fibrous materials associated with a wax. The wax utilized in the solid fuel inner core 115 can be a paraffin wax, soy wax, beeswax, gel wax, palm wax, or other waxes. In some cases, the wax in the solid fuel inner core 115 can have a lower melting point than the wax used in outer shell 110. For example, the wax in the solid fuel inner core 115 can be a semi-soft paraffin wax with a melting point between about 115° F. and about 150° F., and more preferably between about 130° F. and about 145° F. Such a configuration can cause the solid fuel inner core 115 to melt before the outer shell 110 which allows the outer shell 110 to contain the molten fuel. The solid fuel inner core 115 can also include one or more additive materials, such as a dye, a fragrance, an oil, an accelerant, a wax, an acid, and the like.

The fibrous material included in the solid fuel inner core 115 can be any combustible or non-combustible natural or synthetic fibrous material including, but not limited to, cotton, linen, wood, paper, wool, steel wool, vegetable fibers, wood fibers, animal fibers, mineral fibers, metallic fibers, and the like. The fibrous material can be an unwoven or unbraided fibrous material. Unlike woven fibrous materials which restrict the flow of molten wax, unwoven fibrous materials can provide a superabundance of unrestricted paths for wicking the molten wax fuel to the flame resulting in a much larger flame.

In operation, fire starter 100 can be ignited by igniting the wick element 105. Unlike other wick based devices, such as candles, where the wick is both for lighting and the base from where the flame emanates, the function of wick element 105 of the present disclosure is to facilitate ignition of the solid fuel inner core 115. This allows the flame of fire starter 100 to emanate from the much more substantial solid fuel inner core 115 producing a significantly larger flame. When lit, the flame of wick element 105 can (i) generate ample heat to melt a portion of the outer shell 110 and expose the solid fuel inner core 115, can (ii) cause the surface of the solid fuel inner core 115 to ignite, can (iii) form a pool of the molten solid fuel immediately below the surface of the solid fuel inner core 115, and can (iv) cause molten solid fuel to move up to the surface of the solid fuel inner core 115 by capillary action. As the molten solid fuel moves up to the surface of the solid fuel inner core 115, the phase change from a liquid to a gas can be completed and the gas can be consumed by the flame.

The presently disclosed fire starter 100 is configured to sustain a substantially large flame in adverse weather conditions, such as high winds, torrential rain, or blowing snow, to ignite a fire sustaining fuel source. In some cases, the fire starter 100 can sustain a flame that has a height greater than or equal to a dimension of outer shell 110, such as a width, height, length, diameter, and the like. For example, the fire starter 100 can sustain a flame with a height greater than or equal to about 8 inches for an outer shell width, height and length of about 1 inch. In other cases, the fire starter 100 can sustain a flame that has a height greater than or equal to the length of the portion of wick element 105 that protrudes external to the outer shell 110. The height and width of the flame produced by fire starter 100 can be controlled by increasing or decreasing the size and/or shape of the capillary surface area of the solid fuel inner core 115. Details of such a relation between the flame and wick are further described in *Analysis and measurement of candle flame shapes*, P. Sunderland et al., *Proceedings of the Combustion Institute*, Volume 33, Issue 2, 2011, Pages 2489-2496 (2010), incorporated herein by reference in its entirety as are all publications cited herein. Moreover, the fire starter 100 can maintain a substantial flame for at least about 10 minutes. The length of the burn time of the fire starter 100 can be adjusted by altering the size, shape, materials and/or other aspects of the outer shell 110 and solid fuel inner core 115. For example, multiple coats or layers of wax can be used to form the outer shell 110 to increase the burn time of the fire starter.

The individual components of fire starter 100, including the solid fuel inner core 115, the outer shell 110, and the wick element 105, can all be fully waterproof to produce a fire starter 100 that is waterproof without the need for special waterproof packaging or containers. The presently disclosed fire starter has undergone both fresh and salt water immersion testing for 90 days and has had no water permeate into the fire starter and has remained fully functional after testing. The fire starter 100 and its individual components can include odorless, non-toxic, and/or non-flammable materials to ensure the fire starter is safe to use, handle, ship, and/or store. The fire starter 100 can also utilize common, widely available, and/or inexpensive materials to produce a relatively inexpensive fire starter resulting in reduced costs to the consumer. One or more of the materials and/or components of fire starter 100 can be modified to meet the needs of specific fire starting applications. For example, the shape of the fire starter 100 can be altered for aesthetic or decorative purposes when the fire starter is intended for use in in-home fireplaces or wood stoves. Furthermore, the materials used in fire starter 100 can be changed to food-grade materials, such as food-grade paraffin wax, when the fire starter is used for igniting charcoal when cooking.

Figure 2A:
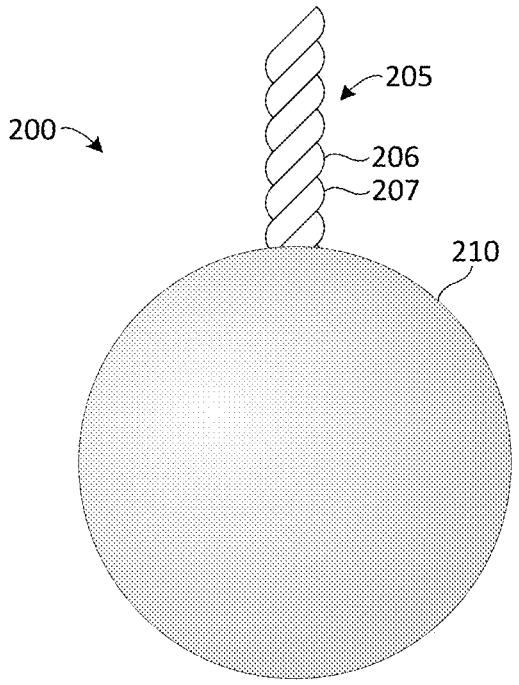
FIG. 2A illustrates a frontal view of a generally spherical fire starter in accordance with an exemplary embodiment.
Figure 2B:
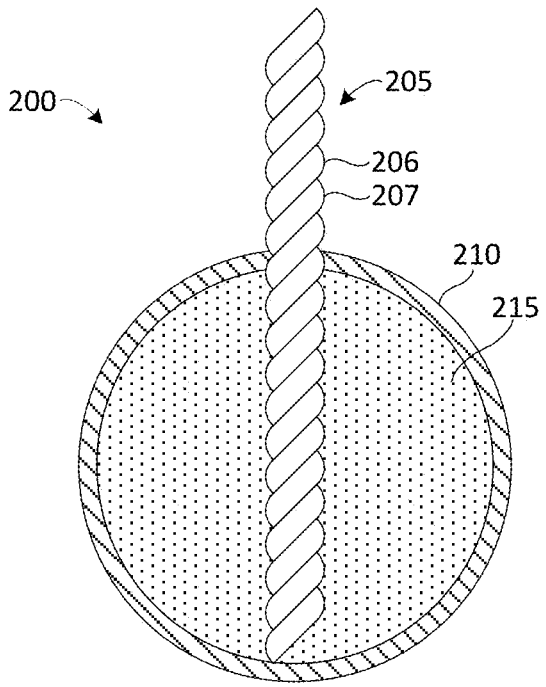
FIG. 2B illustrates a cross-sectional view of a generally spherical fire starter in accordance with an exemplary embodiment.

Although the percent composition of the components of the fire starter 100 will vary based on factors such as size, shape and material choice, in some embodiments the outer shell 110 can constitute between about 5% and about 75% of the volume of the fire starter, preferably between about 5% and about 50% of the volume of the fire starter, and more preferably between about 10% and about 40% of the volume of the fire starter. Similarly, the solid fuel inner core 115 can constitute between about 25% and about 95% of the volume of the fire starter, preferably between about 50% and about 95% of the volume of the fire starter, and more preferably between about 60% and about 90% of the volume of the fire starter. Further, the fire starter can be configured to maintain structural integrity, such as by substantially maintaining its shape and not cracking, when undergoing tensile and/or compressive forces in adverse weather conditions and/or temperatures between about −50° F. and about 100° F. As will be understood by those of skill in the art, the magnitude of forces that the fire starter can sustain while maintaining structural integrity is affected by factors such as the size, shape, material composition and temperature of the fire starter. For example, a fire starter including paraffin wax and having an outer shell with a length, a width and a height of 1 inch can be configured to withstand greater than or equal to 650 kPa of uniaxial loaded pressure at room temperature. Additional discussion of the physical and mechanical properties of the fire starter is described in *Experimental study of physical and mechanical properties of natural and synthetic waxes using uniaxial compressive strength test*, M. Hossain et al., *Proceedings of the Third International Conference on Modeling, Simulation and Optimization* 2009, incorporated herein by reference in its entirety FIGS. 2A and 2B illustrate a frontal view and a cross-sectional view of a generally spherical fire starter 200 in accordance with an exemplary embodiment. Fire starter 200 is substantially similar to fire starter 100 shown in FIGS. 1A and 1B and includes a wick element 205 having one or more wicks 206, 207, an outer shell 210, and a solid fuel inner core 215. However, unlike fire starter 100, the outer shell 210 and inner core 215 are generally spherical in fire starter 200.

Figure 3A:
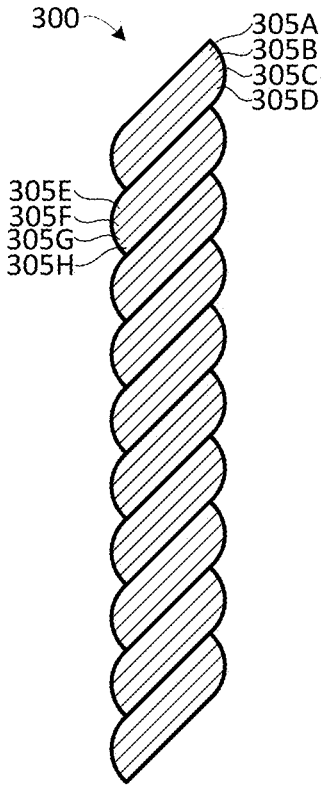
FIG. 3A illustrates a frontal view of a wick element in accordance with an exemplary embodiment.
Figure 3B:
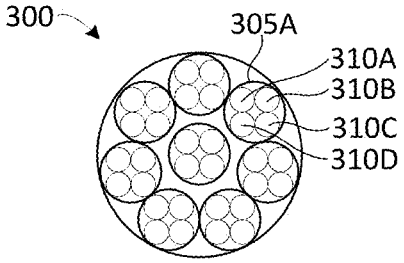
FIG. 3B illustrates a cross-sectional view of a wick element in accordance with an exemplary embodiment.

FIG. 3A illustrates a detailed frontal view of a wick element 300 in accordance with an exemplary embodiment. Wick element 300 can include eight individual wicks 305A-H braided or twisted together. As shown in the cross sectional view of wick element 300 in FIG. 3B, each wick 305A-H in wick element 300 can include multiple individual strands of one or more wicking materials, such as cotton, fiberglass, aramid, denim, hemp, wood, paper, and the like. For example, wick 305A is shown to have four individual wicking elements 310A-D. Such an arrangement gives wick element 300 a total of 32 individual strands of wicking material twisted or braided together. Each of the 32 strands can be separated at the top end of the wick to provide more surface area for ignition and/or re-ignition. By using multiple wicks each having multiple individual strands of wicking material, the wick element 300 is more capable of sustaining a flame and igniting a fire starter in adverse weather conditions, such as high winds, torrential rain, or blowing snow. For instance, in situations where adverse weather conditions extinguish one of the multiple strands 310A-D, or even one of the multiple wicks 305A-H, a neighboring strand and/or wick can subsequently reignite the extinguished strand and/or wick to sustain the flame.

Figure 4:
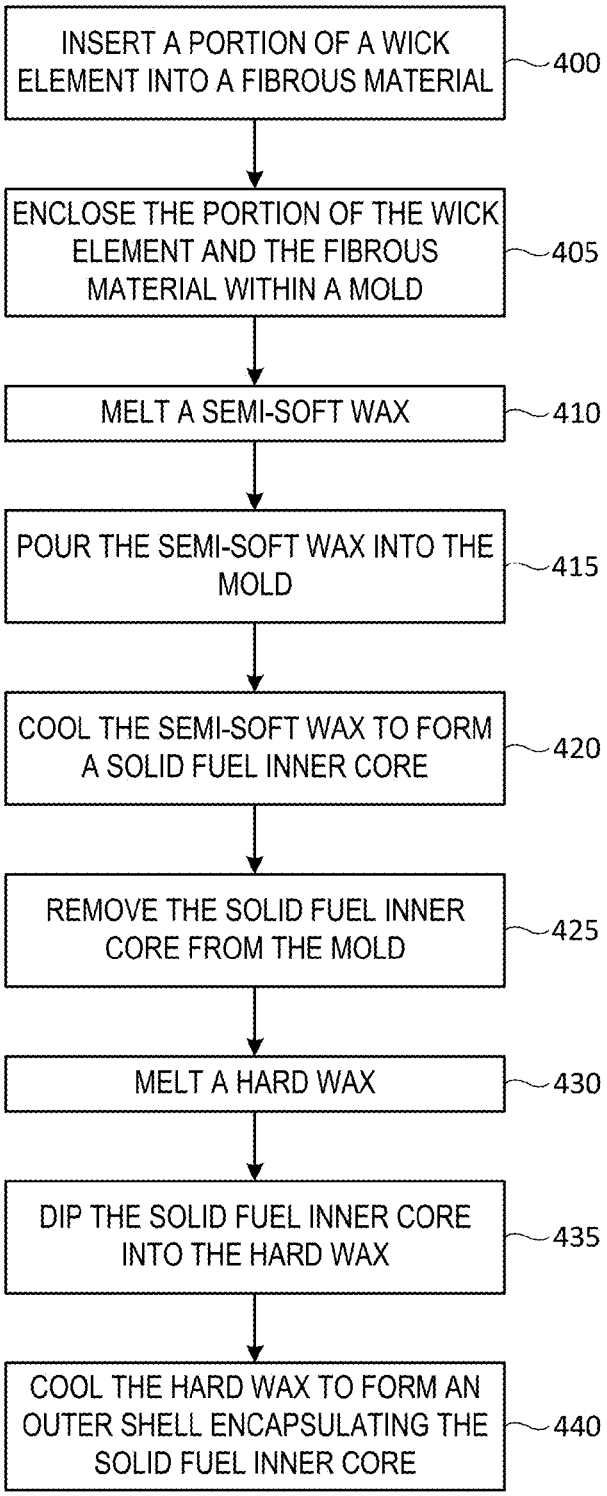
FIG. 4 illustrates an exemplary process for producing a fire starter.

Having disclosed some basic system components and concepts of the fire starter, the disclosure now turns to the example method of producing the fire starter shown in FIG. 4. The steps outlined herein can be implemented in any combination thereof, including combinations that exclude, add, or modify certain steps.

FIG. 4 illustrates an exemplary process for producing a fire starter. At step 400, a portion of a wick element, such as wick element 105, can be placed into a fibrous material. As a non-limiting example, the wick element can be produced by twisting eight individual wicks of four ply 100% cotton yarn (weight category 4) together and associating the twisted wicks with a wax. Once the wax is cooled, the wick element can be cut to the appropriate length. The fibrous material can be, for example, 100% cotton balls, and the portion of the wick element can be placed within a single cotton ball or between two or more cotton balls.

At step 405, the portion of the wick and the fibrous material can be enclosed in a mold. The mold can be a rubber mold and can have a generally cubical shape with an internal width between about 0.5 inches and about 1.5 inches. A semi-soft wax can be melted (step 410) and poured into the mold to associate the portion of the wick and the fibrous material with the wax (step 415). The semi-soft wax can be a semi-soft paraffin wax with a melting point between about 115° F. and about 150° F., and more preferably between about 130° F. and about 145° F.

At step 420, the semi-soft wax can be cooled to form a solid fuel inner core including the portion of the wick element and the fibrous material associated with the semi-soft wax. The portion of the wick element can be integrally molded with the solid fuel inner core such that the inner core substantially encapsulates the portion of the wick element and forms a solid piece containing the portion of the wick element.

Once the solid fuel inner core containing the portion of the wick element has cooled, it can be removed from the mold (step 425). From here, a hard wax can be melted at step 430. The hard wax can be a hard paraffin wax with a melting point between about 140° F. and about 170° F., and more preferably between about 150° F. and about 165° F. At step 435, the solid fuel inner core can be dipped into the molten hard wax. The molten hard wax can subsequently be cooled at step 440 to form a hard outer shell substantially encapsulating the solid fuel inner core.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. Rather, the described features and steps are disclosed as possible components of systems and methods within the scope of the appended claims. Moreover, claim language reciting "at least one of" a set indicates that one member of the set or multiple members of the set satisfy the claim.

What is claimed is:

1. A fire starter, comprising:

a solid fuel inner core comprising a fibrous material associated with a semi-soft wax;

an outer shell external to the inner core and fully encapsulating the inner core, the outer shell comprising a hard wax; and a wick element extending through the outer shell and integrally molded with the inner core.

2. The fire starter of claim 1, wherein the semi-soft wax comprises a paraffin wax with a melting point between about 130° F. and about 145° F.

3. The fire starter of claim 1, wherein the hard wax comprises a paraffin wax with a melting point between about 150° F. and about 165° F.

4. The fire starter of claim 1, wherein the fibrous material comprises cotton.

5. The fire starter of claim 1, wherein the wick element comprises wicking selected from the group consisting of cotton, fiberglass, aramid, denim, hemp, wood, and paper, and further comprises a wax.

6. The fire starter of claim 5, wherein the wick element comprises a plurality of individual wicks, wherein each of the plurality of wicks comprises a plurality of twisted cotton strands.

7. The fire starter of claim 1, wherein the wick element further comprises a stiffener selected from the group consisting of a zinc stiffener, a paper stiffener, and a cotton stiffener.

8. The fire starter of claim 1, wherein the fire starter has a generally cubical shape.

9. The fire starter of claim 1, wherein the association comprises absorption of the semi-soft wax by the fibrous material.

10. The fire starter of claim 1, wherein the association comprises adsorption of the semi-soft wax to the fibrous material.

11. The fire starter of claim 1, wherein at least one of the semi-soft wax and hard wax include one or more additive materials selected from the group consisting of a dye, a fragrance, an oil, an accelerant, a wax, and an acid.

12. A method of making a fire starter, the method comprising:

inserting a portion of a wick element into a piece of fibrous material;

enclosing the portion of the wick element and the piece of fibrous material within a mold;

melting a semi-soft wax;

pouring the semi-soft wax into the mold;

cooling the semi-soft wax to form a solid fuel inner core comprising the portion of the wick element and the fibrous material associated with the semi-soft wax;

removing the solid fuel inner core from the mold;

melting a hard wax;

dipping the solid fuel inner core into the hard wax; and cooling the hard wax to form an outer shell fully encapsulating the solid fuel inner core.

13. The method of claim 12, wherein the semi-soft wax comprises a paraffin wax, and wherein the step of melting the semi-soft wax further comprises:

heating the semi-soft wax to a temperature between 130° F. and 145° F.

14. The method of claim 13, wherein the step of melting the semi-soft wax further comprises:

adding one or more additive materials to the semi-soft wax.

15. The method of claim 12, wherein the hard wax comprises a paraffin wax, and wherein the step of melting the hard wax further comprises:

heating the hard wax to a temperature between 150° F. and 165° F.

16. The method of claim 15, wherein the step of melting the hard wax further comprises:

adding one or more additive materials to the hard wax.

17. The method of claim 12, further comprising:

twisting a plurality of individual wicks together, wherein each of the plurality of wicks comprises a plurality of twisted cotton strands;

dipping the plurality of twisted wicks into a melted wax to associate the wicks with the wax; and cooling the wax-associated wicks to form the wick element.

18. The method of claim 17, further comprising:

inserting a stiffener into the plurality of wicks.

19. The method of claim 12, wherein the fibrous material comprises cotton.

20. The method of claim 12, wherein the association between the fibrous material and the semi-soft wax comprises an adsorption or an absorption.

* * * * *